US007281897B2

(12) United States Patent
Ochiai et al.

(10) Patent No.: US 7,281,897 B2
(45) Date of Patent: Oct. 16, 2007

(54) MULTI-BLADE CENTRIFUGAL BLOWER

(75) Inventors: Toshinori Ochiai, Obu (JP); Masaharu Sakai, Obu (JP); Shoichi Imahigashi, Kariya (JP); Yasushi Mitsuishi, Anjo (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 11/313,173

(22) Filed: Dec. 20, 2005

(65) Prior Publication Data

US 2006/0140758 A1 Jun. 29, 2006

(30) Foreign Application Priority Data

Dec. 24, 2004 (JP) ..... 2004-372912
Sep. 29, 2005 (JP) ..... 2005-283598

(51) Int. Cl.
*F04D 29/30* (2006.01)

(52) U.S. Cl. ..... 416/184; 416/187

(58) Field of Classification Search ..... 415/206, 415/203, 209.4, 119; 416/184, 185, 186 R, 416/187, 214 R
See application file for complete search history.

(56) References Cited

U.S. PATENT DOCUMENTS 6,299,409 B1 * 10/2001 Matsunaga et al. ..... 415/206

FOREIGN PATENT DOCUMENTS

| | | |
|---|---|---|
| JP | 61-107000 | 5/1986 |
| JP | 04-005500 | 1/1992 |
| JP | 2001-115997 | 4/2001 |

* cited by examiner

*Primary Examiner*—Edward K. Look
*Assistant Examiner*—Dwayne J White
(74) *Attorney, Agent, or Firm*—Harness, Dickey & Pierce, PLC

(57) ABSTRACT

Each of blades of a multi-blade centrifugal blower is provided with a taper portion, which is arranged at an inside periphery at least at the side of one rotation-shaft-direction end of the blade and tapers from the side of other rotation-shaft-direction end of the blade toward the side of the one rotation-shaft-direction end. The taper portion is positioned at a rotation-direction front side with respect to a back portion disposed at the side of the other rotation-shaft-direction end of the blade. Each of inlet angles throughout the taper portion is set in a range from 55° to 74°. Therefore, air flowing speed at an outlet of an impeller wheel is uniformed throughout the blade width. Work capacity and efficiency of the impeller wheel are increased, while noise is reduced.

22 Claims, 12 Drawing Sheets

MULTI-BLADE CENTRIFUGAL BLOWER

CROSS REFERENCE TO RELATED APPLICATION

This application is based on Japanese Patent Applications No. 2004-372912 filed on Dec. 24, 2004, and No. 2005-283598 filed on Sep. 29, 2005, the disclosure of which is incorporated herein by reference.

FIELD OF THE INVENTION

The present invention relates to a multi-blade centrifugal blower, which sucks air from a rotation-shaft-direction end side thereof and blows air toward a diameter-direction outer side thereof.

BACKGROUND OF THE INVENTION

A general multi-blade centrifugal blower is shown in FIG. 23. An impeller wheel 7*a* of the blower is accommodated in a casing 7*b*, and provided with multiple blades 71 which are arranged around the central line 70 of a rotation shaft (not shown) of the blower. The blower sucks air through a suction portion 74 disposed at the side of one rotation-shaft-direction end of the blower, and blows air toward a diameter-direction outer side of the blower.

The impeller wheel 7*a* is provided with a large inner/outer diameter ratio and a large blade width (which is dimension in rotation shaft direction of impeller wheel 7*a*). Therefore, the space which is between the adjacent blades 71 and near the suction portion 74 will become an inefficacious zone, where air flowing direction abruptly varies from the rotation shaft direction to the diameter direction to cause a large eddy so that a main air flow does not flow.

Various proposals are made in order to decrease the inefficacious zone and uniform the outlet (of impeller wheel) air flowing speed throughout the blade 71 for the sake of work-capacity increase, efficiency improvement and noise reduction.

In a multi-blade centrifugal blower with reference to JP-61-107000A, the blade is provided with a cross section shape which is inclined from the side of a boss portion (i.e., main plate) toward the side of a support ring (i.e., side plate) in a direction contrary to a rotation direction of the impeller wheel, in order to exert a force in the rotation direction to air to reduce the inefficacious zone.

In a multi-blade centrifugal blower with reference to JP-2001-115997A, a main plate and a side plate are sequentially twisted, in a state where a blade outlet portion of the side of the main plate is positioned at a rotation-direction front side with respect to the blade outlet portion of the side of the side plate. Thus, an inlet angle and an outlet angel which are different from each other are provided.

In a multi-blade centrifugal blower with reference to JP-4-5500A , the blade of the side of a side plate is bent in the rotation direction with respect to the rotation shaft direction of the blower. That is, a bend portion is provided.

However, in the multi-blade centrifugal blowers with reference to JP-61-107000A and JP-2001-115997A, fluid inflow from the rotation shaft direction is not considered, so that little fluid flows into the space which is between the adjacent blades and near the suction portion. Therefore, the improvement effect is petty.

In the multi-blade centrifugal blower with reference to JP-4-5500A, the bend portion deteriorates operation performance and noise even though the fluid inflow from the rotation shaft direction is considered.

SUMMARY OF THE INVENTION

In view of the above-described disadvantage, it is an object of the present invention to provide a multi-blade centrifugal blower having an impeller wheel with increased work capacity. Work efficiency improvement and noise reduction of the multi-blade centrifugal blower are also considered.

According to the present invention, a multi-blade centrifugal blower is provided with an impeller wheel which is rotatable with a center of a rotation shaft thereof, and a casing for accommodating the impeller wheel. The impeller wheel has a plurality of blades which are arranged around the rotation shaft, a side plate which is connected with each of the blades at a side of one rotation-shaft-direction end of the blade, and a main plate which is connected with each of the blades at a side of other rotation-shaft-direction end of the blade. The main plate is integrated with the rotation shaft. When the impeller wheel is rotated, air is sucked through a suction portion formed at the side of the one rotation-shaft-shaft end and is blown toward a diameter-direction outer side of the impeller wheel. An inner periphery of the blade has a taper portion which is arranged at least at the side of the one rotation-shaft-direction end. The taper portion tapers from the side of the other rotation-shaft-direction end toward the side of the one rotation-shaft-direction end. The taper portion is positioned at a front side of a rotation direction R of the impeller wheel with respect to a back portion which is disposed at the side of the other rotation-shaft-direction end of the blade. Each of inlet angles throughout the taper portion has a value in a predetermined range. The inlet angles are respectively at cross sections of the blade which are perpendicular to the inner periphery of the blade in a meridional plane.

Therefore, air readily flows in from the rotation shaft direction in the space which is between the adjacent blades and near the suction portion. Thus, exfoliation is decreased. The inefficacious zone where the main air flow does not pass is reduced. Accordingly, the air flowing speed at an outlet of the impeller wheel is uniformed throughout the blade width (which is dimension in rotation shaft direction), so that work capacity of the impeller wheel is increased.

Preferably, each of the inlet angles throughout the taper portion has the value in the predetermined range substantially from 55° to 76°.

Accordingly, noise of the multi-blade centrifugal blower can be reduced with reference to FIG. 17.

More preferably, each of the inlet angles throughout the taper portion has the value in the predetermined range substantially from 51° to 74°.

Accordingly, the fan efficiency of the multi-blade centrifugal blower can be improved with reference to FIG. 18.

More preferably, a variation in the inlet angles throughout the taper portion is in a range from −5° to +5°.

Thus, air at the taper portion can be readily sucked, because actual inflow angles are substantially independent of the rotation-shaft-direction positions of the taper portion and the inlet angles throughout the taper portion are set substantially equal to each other. Air flow in the rotation shaft direction and that in the diameter direction are considered in the actual inflow angle.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS

First Embodiment

Figure 1:
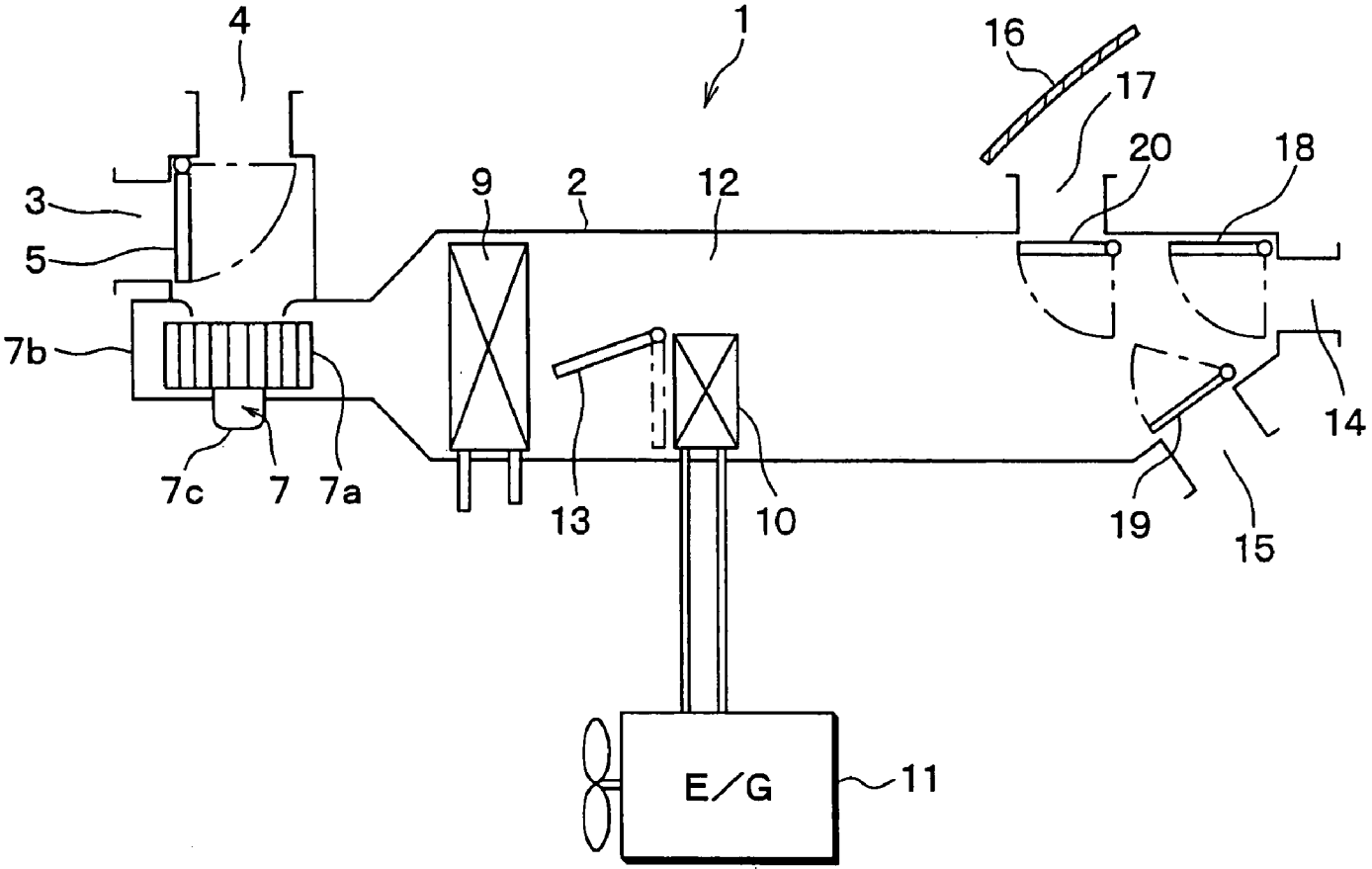
FIG. 1 is a schematic view of a vehicle air conditioner having a multi-blade centrifugal blower according to a first embodiment of the present invention.

A multi-blade centrifugal blower 7 according to a first embodiment of the present invention is suitably used in, for example, an air conditioner 1 for a vehicle. FIG. 1 shows the air conditioner 1 having a water-cooled engine. An air conditioner casing 2 of the air conditioner 1 is provided with an inner-air suction port 3 through which air inside a passenger compartment of the vehicle is introduced into the air conditioner 1, an outer-air suction port 4 through which air outside the passenger compartment is introduced into the air conditioner 1, and a suction-port switching door 5 for selectively closing and opening the suction ports 3 and 4. The suction-port switching door 5, the suction ports 3 and 4 are disposed at an air upstream portion in an air passage defined by the air conditioner casing 2.

The multi-blade centrifugal blower 7 (blower 7) and a filter (not shown) for removing dust in air are arranged in the air conditioner casing 2 and disposed at an air downstream side of the suction-port switching door 5. Air which is sucked by the blower 7 through the suction ports 3 and 4 is blown toward a face blowing-out port 14, a foot blowing-out port 15, a defroster blowing-out port 17 and the like arranged at the air conditioner casing 2.

The blower 7 sucks air in a rotation shaft (not shown) thereof, then blowing air toward a diameter-direction outer side thereof. The blower 7 is provided with an impeller wheel 7*a* made of a resin or the like, a scroll casing 7*b* made of a resin or the like and an electrically-driven motor 7*c* for driving the impeller wheel 7*a*. The impeller wheel 7*a* is rotated with a center of the rotation shaft to blow air toward a diameter-direction outer side of the impeller wheel 7*a* (corresponding to diameter-direction outer side of blower 7). The scroll casing 7*b* for accommodating the impeller wheel 7*a* defines a scroll-shaped air passage for gathering air blown-out by the impeller wheel 7*a*.

An evaporator 9 (air cooling unit) and a heater core 10 (air heating unit) are arranged in the air conditioner casing 2. The evaporator 9 is disposed at the air downstream side of the blower 7. All of air blown by the blower 7 passes through the evaporator 9. The heater core 10, being disposed at the air downstream side of the evaporator 9, heats air by using cooling water of the engine 11 as a heat source.

The air conditioner casing 2 has therein a bypass passage 12 for bypassing the heater core 10. An air mixing door 13 is positioned at the air upstream side of the heater core 10. The air mixing door 13 is controlled to adjust the ratio of the amount of air flowing through the heater core 10 to that flowing through the bypass passage 12, so that the temperature of air blown into the passenger compartment is adjusted.

The air conditioner casing 2 is provided with the face blowing-out port 14 through which air is blown to the upper portion of a passenger in the passenger compartment, the foot blowing-out port 15 through which air is blown to the lower portion of the passenger, the defroster blowing-out port 17 through which air is blown to the inner side of a windshield 16. The blowing-out ports 14, 15 and 17 are arranged at the most downstream portion of the air passage defined in the air conditioner casing 2.

Blowing-out mode switching door 18, 19 and 20 are respectively arranged at the air upstream sides of the blowing-out ports 14, 15 and 17. The Blowing-out mode switching door 18, 19 and 20 are selectively opened and closed, to switch a blowing-out mode among a face mode for blowing air to the upper portion of the passenger, a foot mode for blowing air to the lower portion of the passenger, and a defroster mode for blowing air to the windshield.

FIG. 1 is a schematic view of the ventilation system of the air conditioner 1. Actually, the air conditioner 1 is such arranged that the pressure losses of the ventilation system at the foot mode and the defroster mode are larger than that at the face mode.

Figure 2:
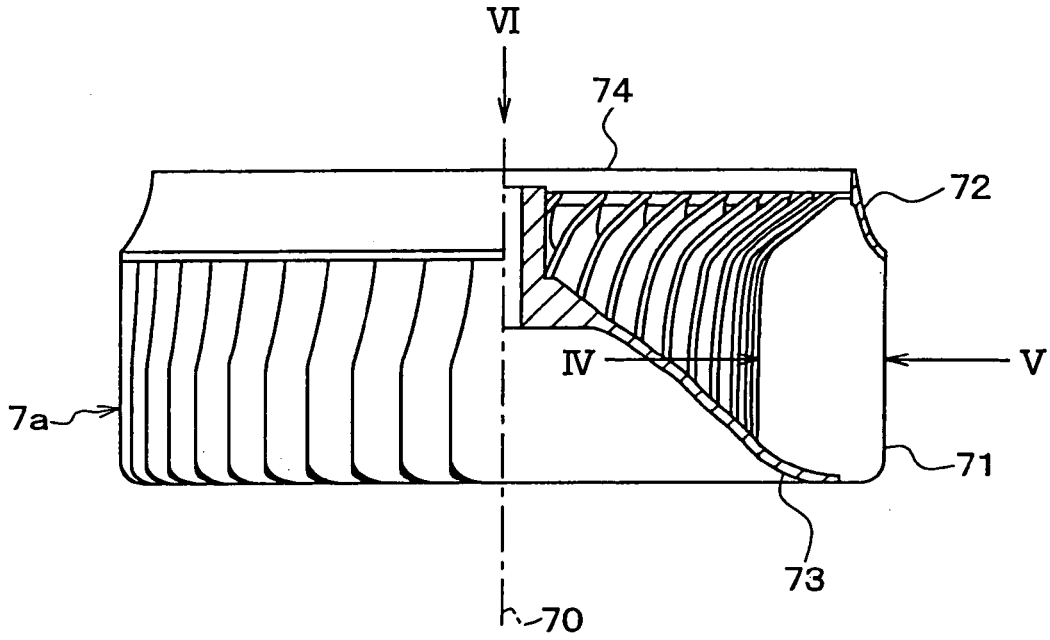
FIG. 2 is a half cross-sectional view of the multi-blade centrifugal blower according to the first embodiment.

As shown in FIG. 2, the impeller wheel 7*a* is provided with multiple blades 71, a ring-shaped side plate 72 and a main plate 73 having a round-disk shape or a substantial cone shape. The small-diameter portion of the cone shape is disposed closer to the side of the side plate 72 than the large-diameter portion thereof.

The blade 71, the side plate 72 and the main plate 73 are made of a resin or the like, and integrated with each other. The blades 71 are arranged around the central line 70 of the rotation shaft of the impeller wheel 7*a* (blower 7). The two rotation-shaft-direction ends of the each blade 71 are respectively connected with the side plate 72 and the main plate 73, which is integrated with the rotation shaft of the impeller wheel 7*a*.

The blower 7 has a suction portion 74 disposed at the side of one rotation-shaft-direction end of the impeller wheel 7*a*. In following description, the side of the one rotation-shaft-direction end of the impeller wheel 7*a* is represented as the one rotation-shaft-direction end side. When the impeller wheel 7*a* is rotated, air flowing into the impeller wheel 7*a* through the suction portion 74 is sucked into spaces each of which is disposed between the adjacent blades 71, and then blown toward the diameter-direction outer side of the impeller wheel 7*a* due to the centrifugal force.

Figure 3:
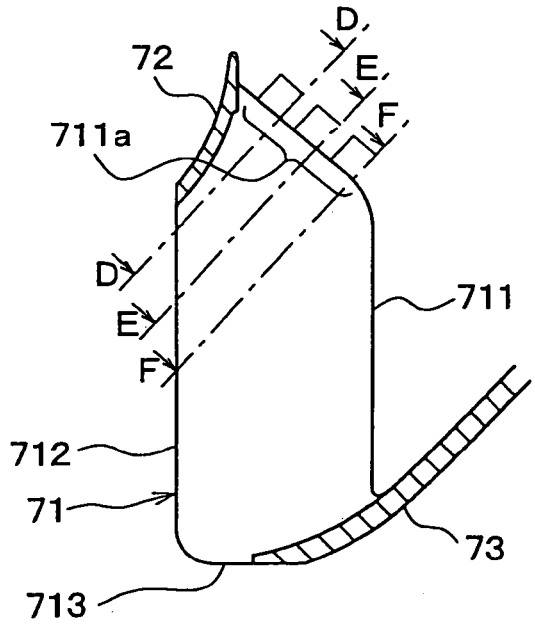
FIG. 3 is a meridional plane view of a main part of an impeller wheel in FIG. 2.

As shown in FIG. 3, the blade 71 has a taper portion 711*a*,which has a substantially linear shape or the like. The taper portion 711*a* is formed at an inside periphery 711 (which is disposed at diameter-direction inner side of impeller wheel 7*a*) of the blade 71, and disposed at one rotation-shaft-direction end side. That is, the taper portion 711*a* provided for the inside periphery 711 is positioned at the side of the suction portion 74.

The taper portion 711*a* tapers from the side of the other rotation-shaft-direction end of the impeller wheel 7*a* toward the one rotation-shaft-direction end side. That is, the side of the other rotation-shaft-direction end (of impeller wheel 7*a*) of the taper portion 711*a* is positioned at the relatively inner side of the impeller wheel 7*a*, as compared with the one rotation-shaft-direction end side of the taper portion 711*a*. In following description, the side of the other rotation-shaft-direction end of the impeller wheel 7*a* is represented as the other rotation-shaft-direction end side.

Figure 4:
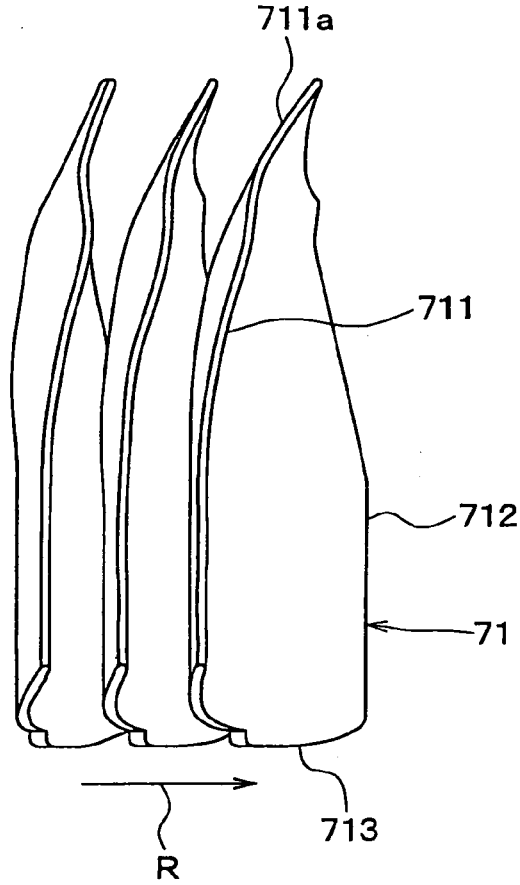
FIG. 4 is a view of blades viewed in an arrow direction IV in FIG. 2.

Referring to FIG. 4, the inside periphery 711 of the blade 71 is provided with a locus, which advances in a rotation direction R of the impeller wheel 7*a* from the other rotation-shaft-direction end side of the inside periphery 711 toward the one rotation-shaft-direction end side thereof. That is, the inside periphery 711 at the side of the side plate 72 is disposed at the rotation-direction front side (i.e., front side of rotation direction R) with respect to the inside periphery 711 at the side of the main plate 73.

Figure 5:
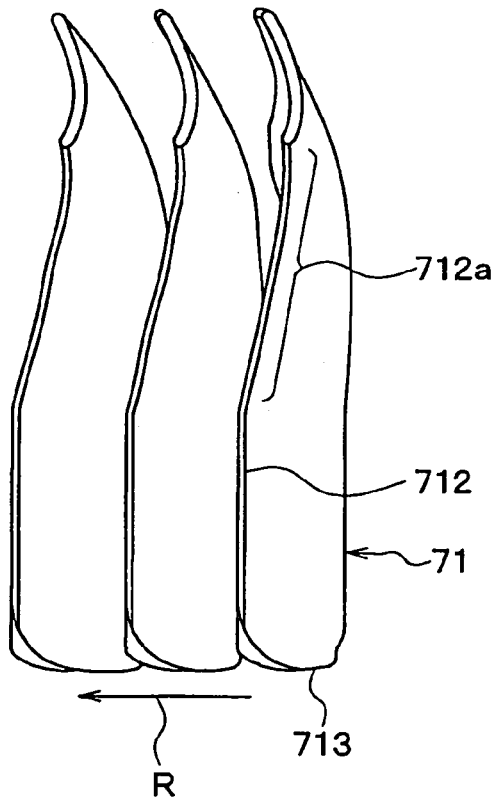
FIG. 5 is a view of the blades viewed in an arrow direction V in FIG. 2.

Referring to FIG. 5, an outside periphery 712 (which is disposed at diameter-direction outer side of impeller wheel 7*a*) of the blade 71 has a portion 712*a* disposed at the one rotation-shaft-direction end side of the outside periphery 712. The portion 712*a* is provided with a locus which backs in the rotation direction R from the other rotation-shaft-direction end side of the portion 712*a* toward the one rotation-shaft-direction end side thereof. That is, the portion 712*a* of the one rotation-shaft-direction end side is disposed at the rotation-direction back side (i.e., back side of rotation direction R) with respect to the portion 712*a* of the other rotation-shaft-direction end side.

Because the portion 712*a* (at the one rotation-shaft-direction end side) of the outside periphery 712 of the blade 71 has the locus which backs in the rotation direction R from the other rotation-shaft-direction end side of the portion 712*a* toward the one rotation-shaft-direction end side thereof, force in the rotation shaft direction is exerted to air so that an inefficacious zone is reduced. Therefore, the air flowing speed at the outlet of the impeller wheel 7*a* can become even throughout the blade width (which is dimension in rotation shaft direction).

Figure 6:
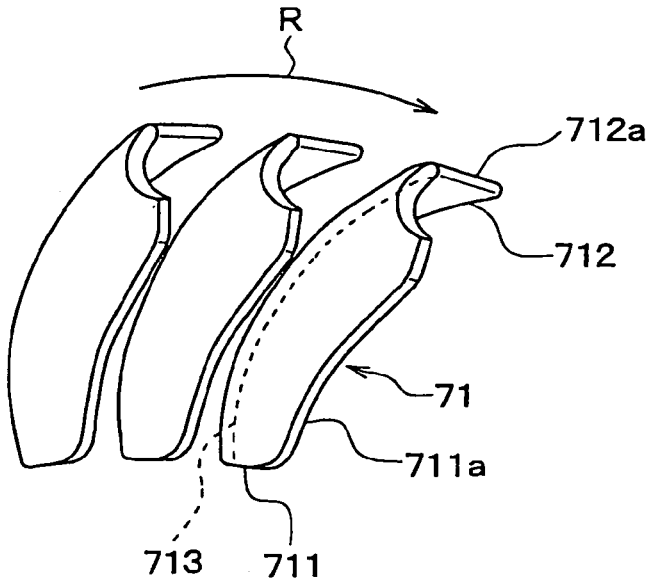
FIG. 6 is a view of the blades viewed in an arrow direction VI in FIG. 2.

Referring to FIG. 6, the taper portion 711*a* is positioned at the rotation-direction front side with respect to a back portion 713 (at the other rotation-shaft-direction end side) of the blade 71. The blower 7 sucks air from the rotation shaft direction thereof, then blowing out the air toward the diameter-direction outer side thereof. Therefore, at the vicinity of the suction portion 74 (that is, at the vicinity of taper portion 711*a*), air can be readily sucked into the space between the adjacent blades 71 from the rotation shaft direction.

Therefore, exfoliation can be reduced and the inefficacious zone where the main flowing of air does not flow can be decreased in the space which is between the blades 71 and at the vicinity of the suction portion 74. Accordingly, the air flowing speed at the outlet of the impeller wheel 7*a* is substantially uniformed throughout the blade width. Thus, the efficiency of the impeller wheel 7*a* can be increased, and the noise can be reduced.

Moreover, as shown in FIG. 3, the whole taper portion 711*a* of the blade 71 is provided with substantially same inlet angles at different cross sections (taken along D-D, E-E, and F-F, for example) of the blade 71. The cross section is perpendicular to the inside periphery 711 formed by the blade 71 in the meridional plane. In this case, the variation in the inlet angles throughout the taper portion 711*a* is in the range substantially from −5° to +5°. The inlet angle is an intersection angle between the blade 71 and the tangent of the inner-track circle of the impeller wheel 7*a*.

Next, the reason that the inlet angles throughout the taper portion 711*a* are set substantially same with each other will be described.

Figure 7:
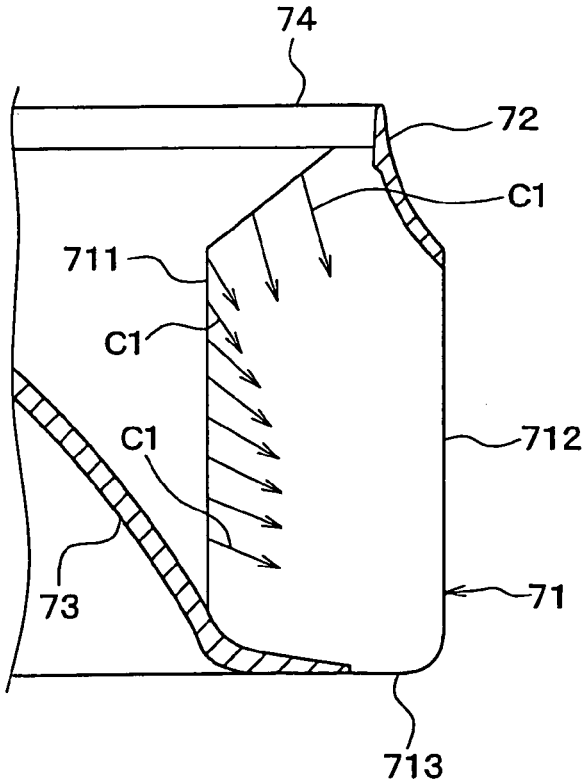
FIG. 7 is a meridional plane view of the main part of the impeller wheel in FIG. 2.
Figure 8:
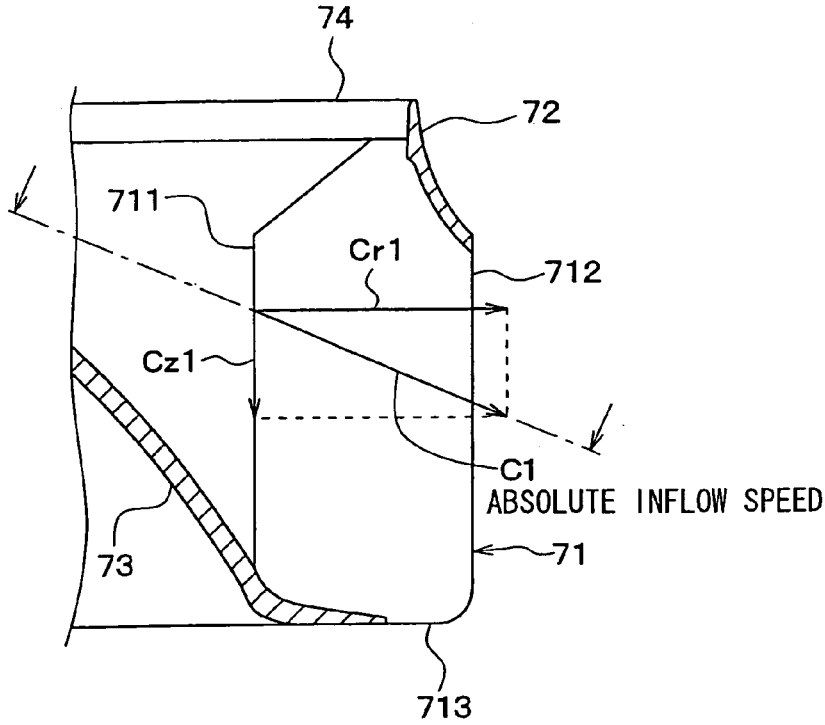
FIG. 8 is a meridional plane view of the main part of the impeller wheel in FIG. 2.
Figure 9:
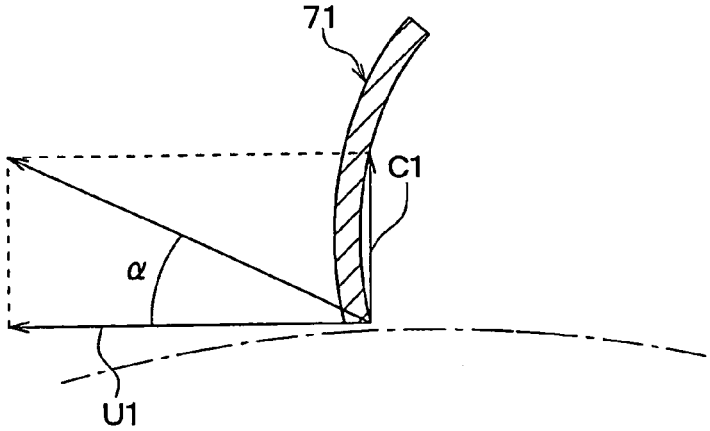
FIG. 9 is cross-sectional view of the blade taken along an absolute inflow speed shown in FIG. 8.

Referring to FIGS. 7 and 8, an absolute inflow speed C1 (Cr1, Cθ1, Cz1) of air flowing through the inside periphery 711 of the blade 71 is detected at different height positions (i.e., rotation-shaft-direction positions) of the blade 71. As shown in FIG. 9 which is cross-sectional view of the blade 71 taken along the direction of the absolute inflow speed C1, an actual inflow angle at the inside periphery 711 of the blade 71 is defined as α in which speed components in the rotation shaft direction and the diameter direction of the blower 7 are considered. The actual inflow angle α is calculated according to a circumferential speed U1 and the absolute inflow speed C1 at the inside periphery 711 of the blade 71. In this case, because a reserve rotation is not provided, Cθ1 is zero.

Figure 10:
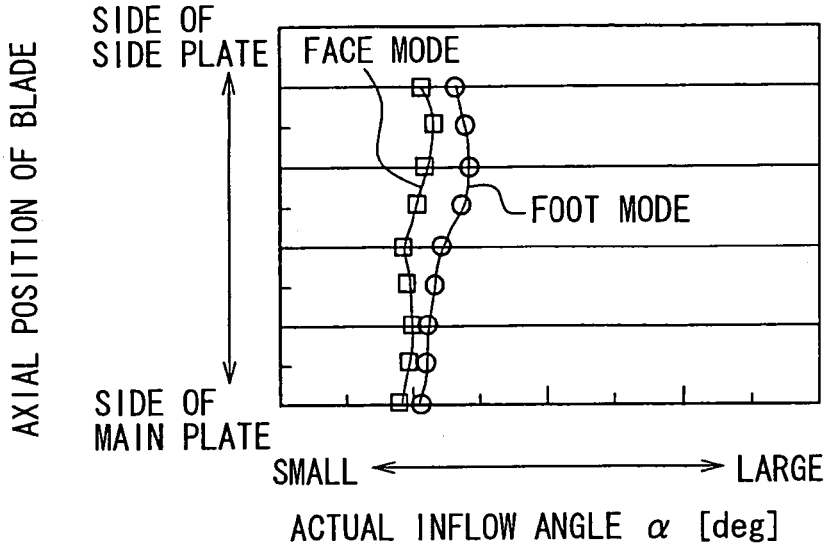
FIG. 10 is a graph showing a relation of a rotation-shaft-direction position of the blade to an actual inflow angle $\alpha$.

FIG. 10 shows the actual inflow angles α responding to the rotation-shaft-direction positions (axial positions) of the blade 71. Referring to FIG. 10, the actual inflow angles α are substantially same with each other and independent of the rotation-shaft-direction positions of the blade 71. As described above, the inlet angles (of taper portion 711*a*) at the cross sections perpendicular to the inside periphery 711 (in meridional plane) of the blade 71 are set substantially same to each other. Thus, air can be readily sucked from the rotation shaft direction of the blower 7 at the taper portion 711*a*.

Figure 11:
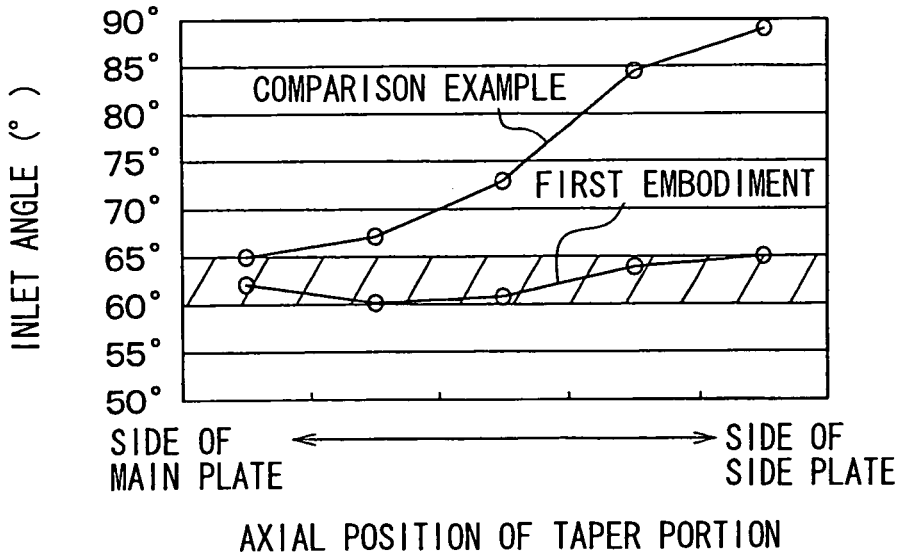
FIG. 11 is a graph showing a relation of a rotation-shaft-direction position of a taper portion to an inlet angle.

FIG. 11 shows the inlet angles throughout the taper portion 711*a* at the cross sections perpendicular to the inside periphery 711 (at meridional plane thereof) of the blade 71, responding to the rotation-shaft-direction positions (axial positions) of the taper portion 711*a*. As shown in FIG. 11, the inlet angle of a taper portion of a conventional blade (as comparison example) is not substantially fixed, but becoming larger toward the side of a side plate. On the other hand, according to this embodiment, the inlet angles throughout the taper portion 711*a* are set in the range substantially from 60° to 65°.

Figure 12A:
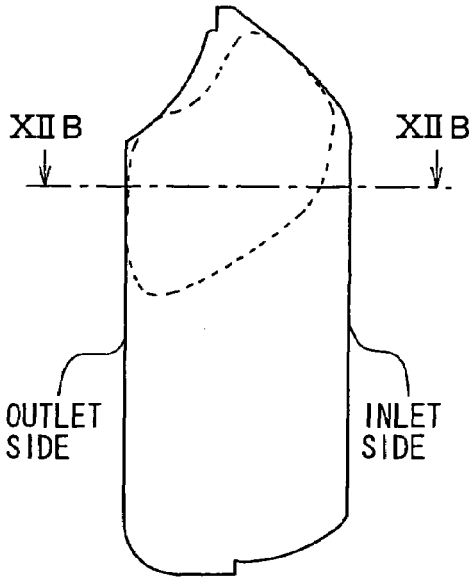
FIG. 12A RELATED ART
FIG. 12A is a schematic view showing a space between blades of a blower according to a related art.
Figure 12B:
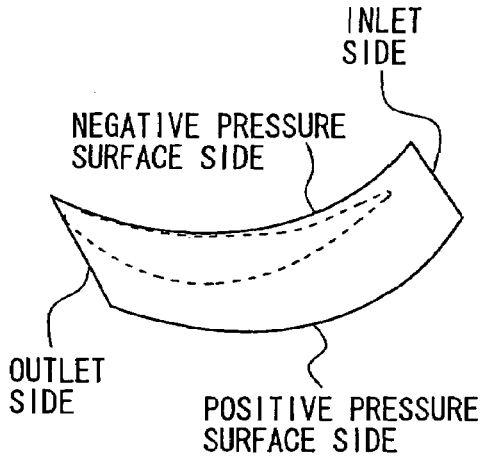
FIG. 12B RELATED ART
FIG. 12B is a schematic cross-sectional view taken along a line XIIB-XIIB in FIG. 12A.
Figure 13A:
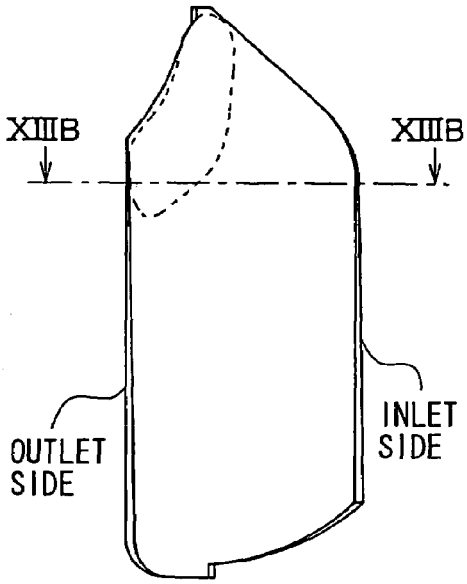
FIG. 13A is a schematic view showing a space between the blades of the blower according to the first embodiment.
Figure 13B:
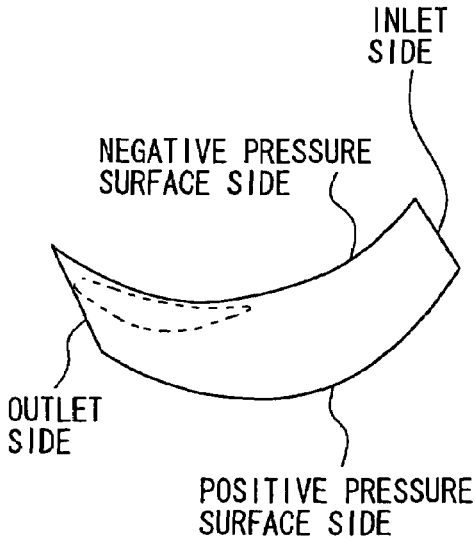
FIG. 13B is a schematic cross-sectional view taken along a line XIIIB-XIIIB in FIG. 13A.

Air flow in the space between the adjacent blades 71 is examined by CFD (Computational Fluid Dynamics) analysis with reference to FIGS. 12A-13B, where the solid-line range indicates the space between the blades and the broken-line range indicates the inefficacious zone. FIGS. 12A and 12B show the space between the adjacent blades of the conventional blower. FIGS. 13A and 13B show the space between the adjacent blades 71 of the blower 7 of the first embodiment.

Referring to FIGS. 12A-13B, air flow (air suction) through the taper portion 711*a* is increased and air discharge is uniformed in the rotation shaft direction of the blower 7 according to the first embodiment, as compared with the conventional blower. The inefficacious zone through which main air flow does not flow is reduced.

Figure 14:
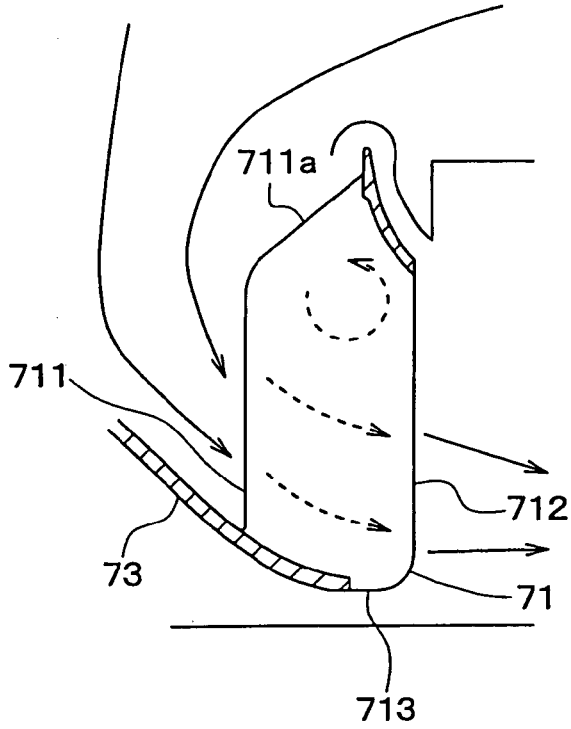
FIG. 14 is a schematic view showing air flow of the blower according to the related art.
Figure 15:
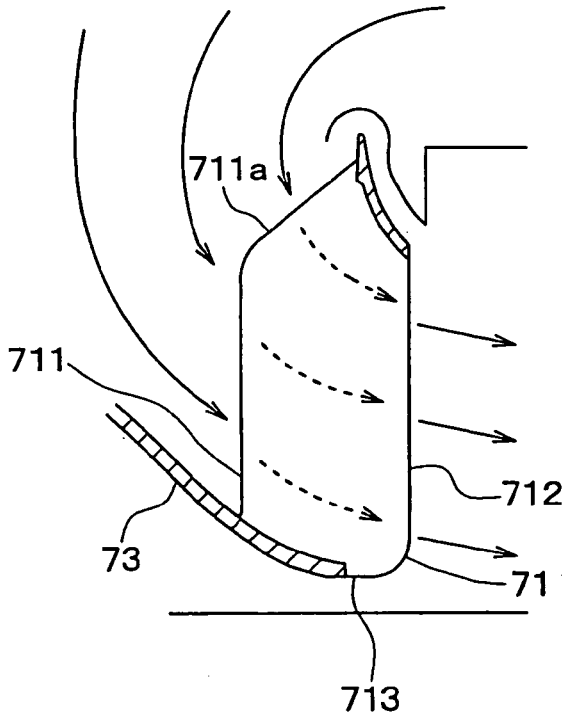
FIG. 15 is a schematic view showing air flow of the blower according to the first embodiment.

Air suction into (flowing into) the space between the blades 71 and air discharge from the space are visualized, as shown in FIGS. 14 and 15 where air flow is indicated by the arrows. FIG. 14 shows air flow through the conventional blower. FIG. 15 shows air flow through the blower 7 according to this embodiment.

In the conventional blower with reference to FIG. 14, air at the taper portion 711*a* is hardly sucked. Because the inlet angle is not suitably set, exfoliation caused by sucked air is large. At the discharge side, air flow is biased to the other rotation-shaft-direction end side (opposite to the side of suction portion 74), so that air discharge at the one rotation-shaft-direction end side (side of suction portion 74) is decreased.

In the blower 7 of this embodiment with reference to FIG. 15, air at the taper portion 711*a* is sucked, and air discharge is sufficiently processed at the one rotation-shaft-direction end side (side of suction portion 74). That is, air flow becomes even at the suction side, the discharge side, and the space between the blades. Accordingly, the air flowing speed can be decreased, while the same flow amount of air can be maintained. Thus, noise and fluid loss can be reduced.

Moreover, the relations of the flow amount coefficient respectively to the pressure coefficient, the specific sound level and the fan efficiency are examined, respectively with respect to the conventional blower and the blower 7 of this embodiment. The blower 7 which is experimented is provided with the taper portion 711*a* having the inlet angle 62° at the cross sections perpendicular to the inside periphery 711 of the blade 71 in the meridional plane. The flow amount coefficient, the pressure coefficient, the specific sound level and the fan efficiency are defined according to JIS B 0132.

Figure 16:
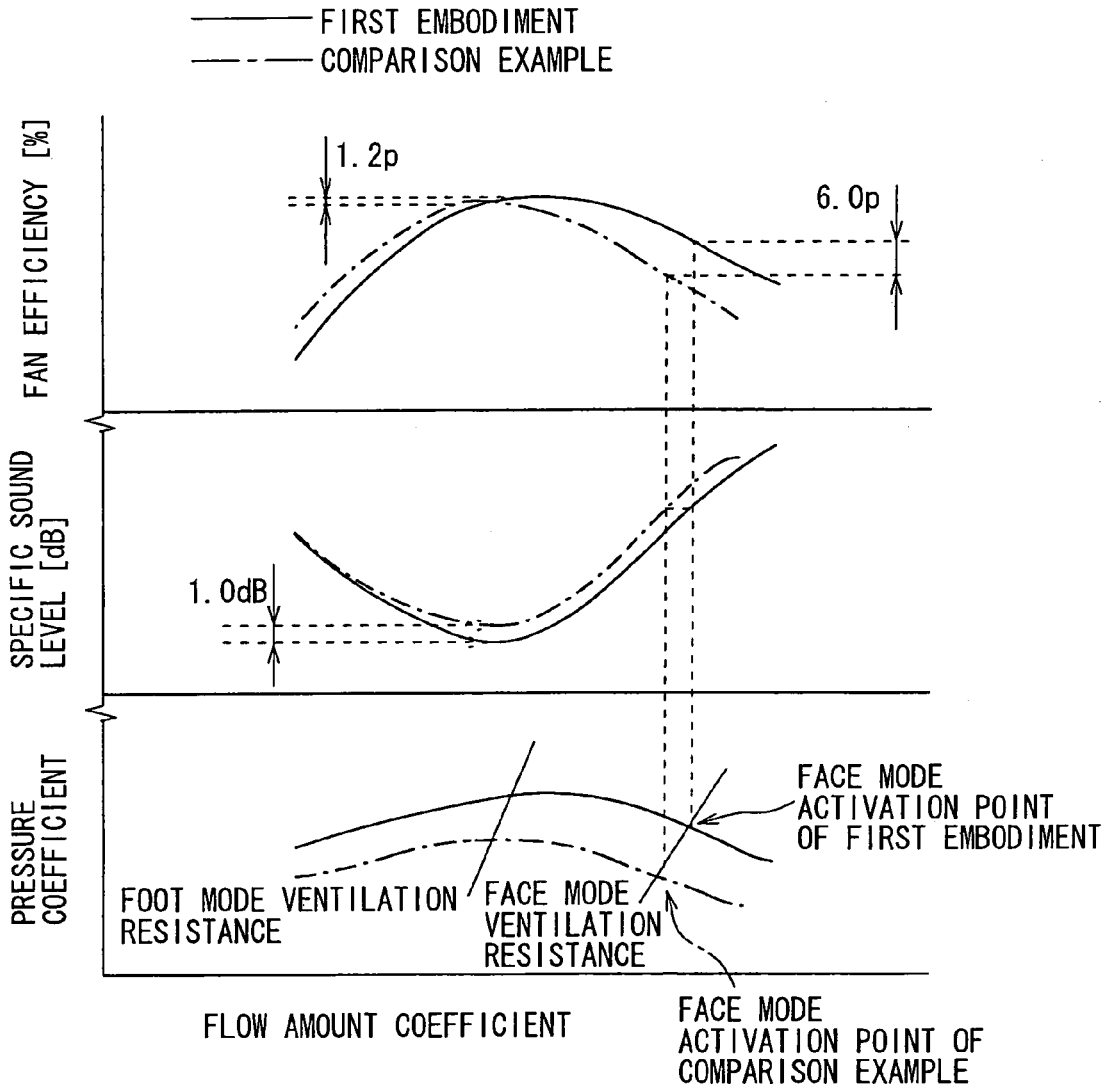
FIG. 16 is a graph showing relations of flow amount coefficient respectively to pressure coefficient, specific sound level and fan efficiency according to the first embodiment and those according to the related art.

As described above, because the blower 7 of this embodiment is provided with the even air flow at the suction side, the discharge side and the space between the blades 71, the inefficacious zone at the impeller wheel 7*a* is decreased. As shown in FIG. 16, at the face mode where the pressure loss is small, the fan efficiency is increased by 6.0 points and the pressure coefficient is improved while the specific sound level is maintained at the substantially same level, as compared with the conventional blower. Moreover, at the foot mode where the presser loss is relatively large, the fan efficiency is increased by 1.2 point, the specific sound level is decreased by 1.0 dB and the pressure coefficient is improved, as compared with the conventional blower.

Figure 17:
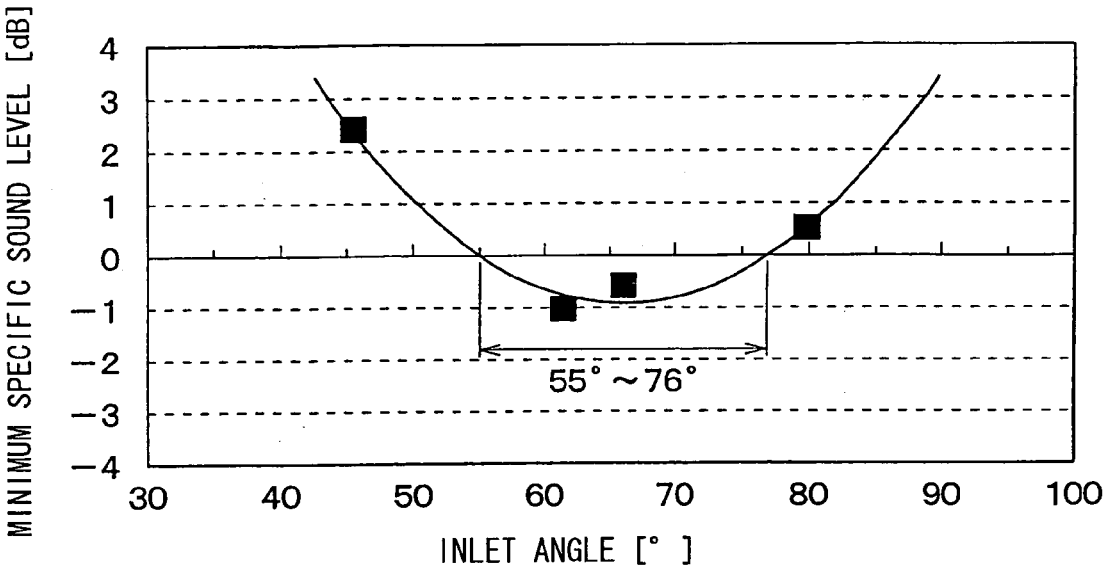
FIG. 17 is a graph showing a relation of minimum specific sound level of the blower according to the first embodiment relative to a criterion of minimum specific sound level of the blower according to the related art, to the inlet angle of the taper portion.
Figure 18:
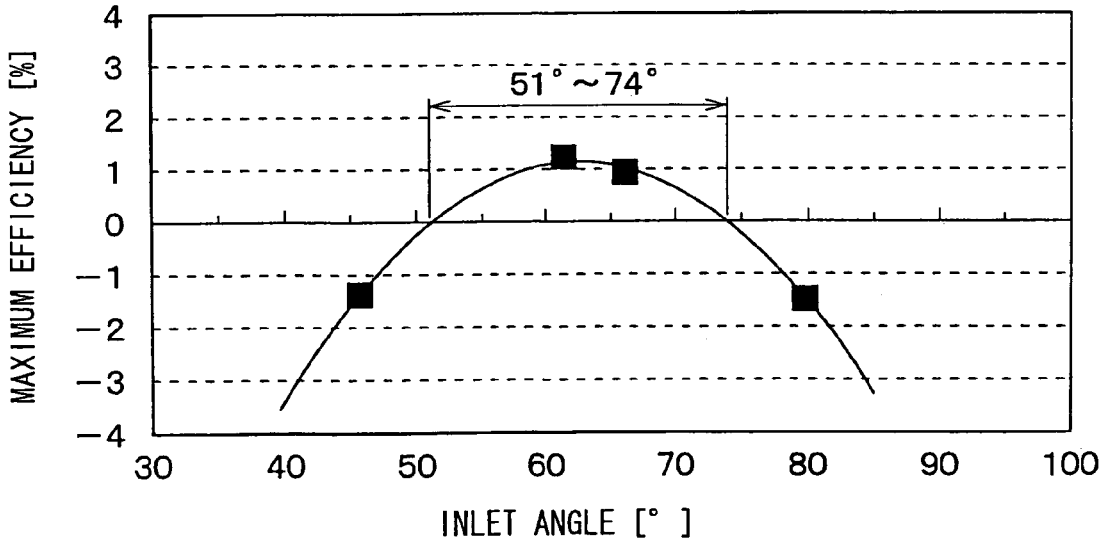
FIG. 18 is a graph showing a relation of maximum fan efficiency of the blower according to the first embodiment relative to a criterion of maximum fan efficiency of the blower according to the related art, to the inlet angle of the taper portion.

As described above, the same inlet angles are provided throughout the taper portion 711*a* of the blower 7 of the first embodiment. The suitable inlet-angle value of the taper portion 711*a* is investigated by prototyping the blower 7 which is respectively provided with various inlet-angle values. The minimum specific sound level and the maximum fan efficiency of the blower 7 corresponding to the various inlet-angle values are detected. FIG. 17 shows the minimum specific sound level of the blower 7 of this embodiment relative to a criterion of that of the conventional blower. FIG. 18 shows the maximum fan efficiency of the blower 7 of this embodiment relative to a criterion of that of the conventional blower. In FIGS. 17 and 18, the lateral axis indicates the inlet-angle value.

Referring to FIG. 17, when the blower 7 of this embodiment is provided with the inlet-angle value in the rang from 55° to 76°, the minimum specific sound level is deceased as compared with the conventional blower. Referring to FIG. 18, when the blower 7 of this embodiment is provided with the inlet-angle value in the range from 51° to 74°, the maximum fan efficiency is improved as compared with the conventional blower.

Therefore, in the case where the inlet angles throughout the taper portion 711*a* are provided with the value in the range from 55° to 74°, noise can be restricted while the fan efficiency can be improved.

Second Embodiment

Figure 19:
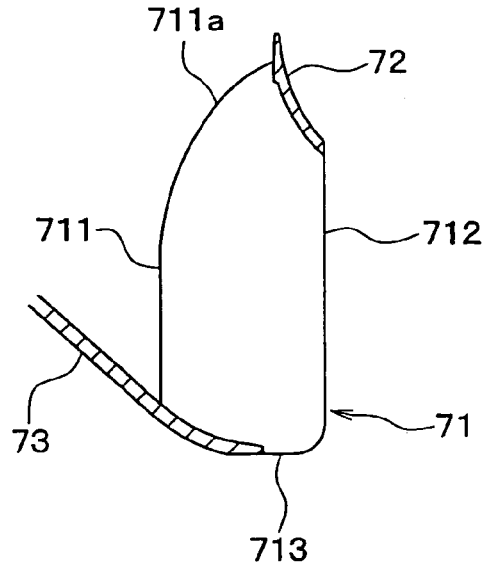
FIG. 19 is a meridional plane view of a main part of an impeller wheel of a multi-blade centrifugal blower according to a second embodiment of the present invention.

According to a second embodiment of the present invention, referring to FIG. 19, the taper portion 711*a* of the blade 71 has a substantial arc shape. Thus, a smooth curved surface can be readily provided for the blade 71.

Third Embodiment

Figure 20:
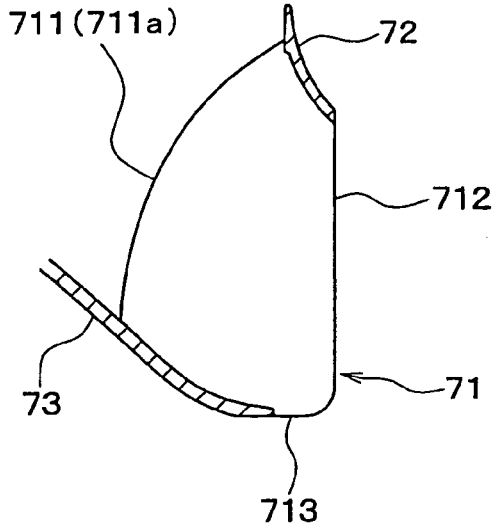
FIG. 20 is a meridional plane view of a main part of an impeller wheel of a multi-blade centrifugal blower according to a third embodiment of the present invention.

According to a third embodiment of the present invention, referring to FIG. 20, the taper portion 711*a* extends to the whole inside periphery 711 of the blade 71. The taper portion can have a substantial arc shape, for example.

The taper portion 711*a* tapers from the other rotation-shaft-direction end side (i.e., opposite side to suction portion 74) of the taper portion 711*a* toward the one rotation-shaft-direction end side (i.e., side of suction portion 74) thereof. That is, the other rotation-shaft-direction end side of the taper portion 711*a* is positioned at the relatively inner side of the impeller wheel 7*a*, as compared with the one rotation-shaft-direction end side of the taper portion 711*a*.

Fourth Embodiment

Figure 21:
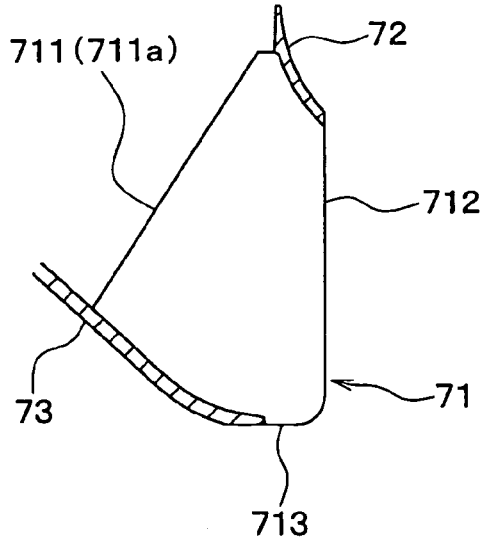
FIG. 21 is a meridional plane view of a main part of an impeller wheel of a multi-blade centrifugal blower according to a fourth embodiment of the present invention.

According to a fourth embodiment of the present invention, referring to FIG. 21, the taper portion 711*a* extends to the whole inside periphery 711 of the blade 71. The taper portion can have a substantially linear shape, for example.

The taper portion 711*a* tapers from the other rotation-shaft-direction end side (i.e., opposite side to suction portion 74) of the taper portion 711*a* toward the one rotation-shaft-direction end side (i.e., side of suction portion 74) thereof. That is, the other rotation-shaft-direction end side of the taper portion 711*a* is positioned at the relatively inner side of the impeller wheel 7*a* , as compared with the one rotation-shaft-direction end side of the taper portion 711*a*.

Fifth Embodiment

Figure 22:
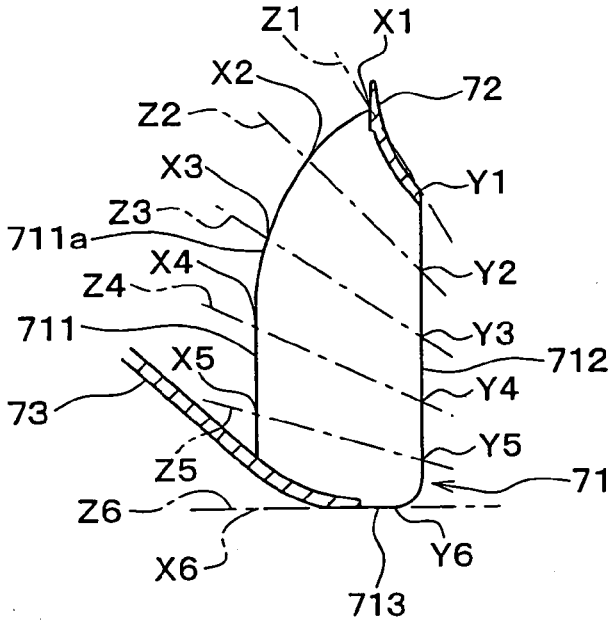
FIG. 22 is a meridional plane view of a main part of an impeller wheel of a multi-blade centrifugal blower according to a fifth embodiment of the present invention.
Figure 23:
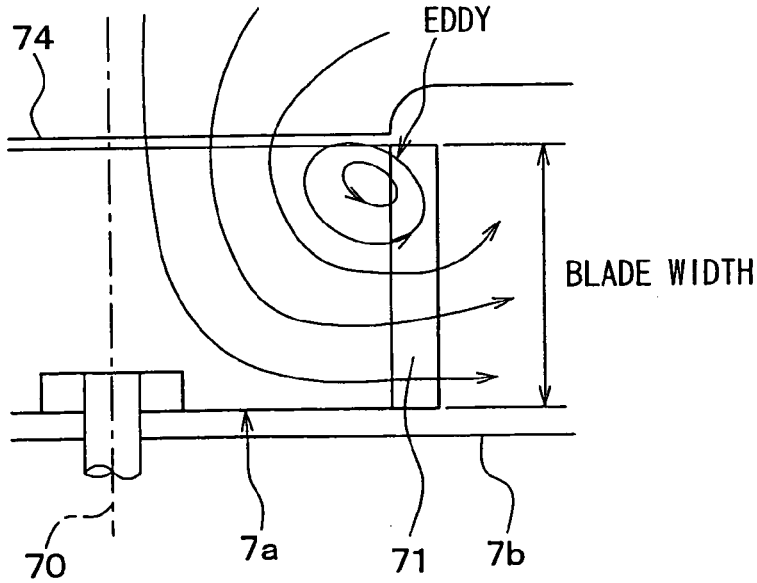
FIG. 23 RELATED ART
FIG. 23 is a schematic view showing the multi-blade centrifugal blower according the related art.

According to a fifth embodiment of the present invention, referring to FIG. 22, the variation in the inlet angles throughout the inside periphery 711 is set in the range substantially from −5° to +5°. The inlet angles are at the cross sections of the blade 71 taken along division lines Z1-Zn (n is a predetermined number, for example, n=6).

The division lines Z1-Zn are defined as following. As shown in FIG. 22, inside-periphery division points X1-Xn are evenly dispersed at the whole inside periphery 711. Each of the inside-periphery division points X1-Xn is distanced from the adjacent inside-periphery division points by a same length along the inside periphery 711. The division points X1, X2, . . . Xn are arranged sequentially from the one rotation-shaft-direction end side (side of suction portion 74) of the inside periphery 711 to the other rotation-shaft-direction end side (opposite side to suction portion 74) of the inside periphery 711.

Outside-periphery division points Y1-Yn are evenly dispersed at the whole outside periphery 712. Each of the outside-periphery division points Y1-Yn is distanced from the adjacent outside-periphery division points by a same length along the outside periphery 712. The division points Y1, Y2, . . . Yn are arranged sequentially from the one rotation-shaft-direction end side (side of suction portion 74) of the outside periphery 712 to the other rotation-shaft-direction end side (opposite side to suction portion 74) of the outside periphery 712.

The division line Zi (i=1, 2 . . . , n) connects the inside-periphery division point Xi with the outside-periphery division point Yi.

According to this embodiment, the variation in the inlet angles throughout the inside periphery 711 is in the range substantially from −5° to +5°, so that design surfaces of the blade 71 will not intersect each other. Thus, the design of the blade 71 is simplified.

Other Embodiment

Although the present invention has been fully described in connection with the preferred embodiments thereof with reference to the accompanying drawings, it is to be noted that various changes and modifications will become apparent to those skilled in the art.

In the above-described embodiments, the portion 712*a* is provided with the locus which backs in the rotation direction R from the other rotation-shaft-direction end side of the portion 712*a* toward the one rotation-shaft-direction end side thereof. However, at least one part of the outside periphery 712 can be also arranged not to back in the rotation direction R from the other rotation-shaft-direction end side to the one rotation-shaft-direction end side thereof. For example, at least one part of the outside periphery 712 of the blade 71 can be parallel to the rotation shaft of the impeller wheel 7*a*.

In the above-described embodiments, the multi-blade centrifugal blower 7 is suitably used for the air conditioner 1. However, the multi-blade centrifugal blower 7 can be also used for other systems for blowing air.

Such changes and modifications are to be understood as being in the scope of the present invention as defined by the appended claims.

What is claimed is:

1. A multi-blade centrifugal blower comprising:

an impeller wheel which is rotatable with respect to a rotation shaft thereof, the impeller wheel having a plurality of blades which are arranged around the rotation shaft, a side plate which is connected with each of the blades at a side of one rotation-shaft-direction end of the blade, and a main plate which is connected with each of the blades at a side of an other rotation-shaft-direction end of the blade, the main plate being integrated with the rotation shaft; and a casing for accommodating the impeller wheel, wherein:

when the impeller wheel is rotated, air is sucked through a suction portion formed at the side of the one rotation-shaft-direction end and is blown toward a diameter-direction outer side of the impeller wheel;

an inside periphery of the blade has a taper portion which is arranged at least at the side of the one rotation-shaft-direction end, the taper portion tapering from the side of the other rotation-shaft-direction end toward the side of the one rotation-shaft-direction end;

in a rotation-shaft-direction cross section of each blade, the taper portion is positioned at a front side of a rotation direction R of the impeller wheel with respect to a back portion which is disposed at the side of the other rotation-shaft-direction end of the blade; and each of inlet angles throughout the taper portion has a value in a predetermined range, the inlet angles being respectively at cross sections of the blade which are perpendicular to the inside periphery of the blade in a meridional plane.

2. The multi-blade centrifugal blower according to claim 1, wherein each of the inlet angles throughout the taper portion has the value in the predetermined range substantially from 55° to 76°.

3. The multi-blade centrifugal blower according to claim 2, wherein the inlet angles of the taper portion are equal to or smaller than 74°.

4. The multi-blade centrifugal blower according to claim 1, wherein each of the inlet angles throughout the taper portion has the value in the predetermined range substantially from 51° to 74°.

5. The multi-blade centrifugal blower according to claim 1, wherein a variation in the inlet angles throughout the taper portion is in a range from −5° to +5°.

6. The multi-blade centrifugal blower according to claim 1, wherein a variation in inlet angles throughout the inside periphery of the blade is in a range from −5° to +5°, the inlet angles being respectively at cross sections taken along division lines Z1-Zn which respectively connect inside-periphery division points X1-Xn with outside-periphery division points Y1-Yn, the inside-periphery division points X1-Xn being evenly dispersed at the whole inside periphery and being arranged sequentially from the side of the one rotation-shaft-direction end to the side of the other rotation-shaft-direction end, each of the inside-periphery division points X1-Xn being distanced from the adjacent inside-periphery division points by a same length along the inside periphery, the outside-periphery division points Y1-Yn being evenly dispersed at a whole outside periphery of the blade and being arranged sequentially from the side of the one rotation-shaft-direction end to the side of the other rotation-shaft-direction end, each of the outside-periphery division points Y1-Yn being distanced from the adjacent outside-periphery division points by a same length along the outside periphery, the division line Zi (i=1, 2 . . . , n) connecting the inside-periphery division point Xi with the outside-periphery division point Yi, n being a predetermined number.

7. The multi-blade centrifugal blower according to claim 1, wherein at least a part of an outside periphery of the blade has a locus which backs in the rotation direction R from the side of the other rotation-shaft-direction end toward the side of the one rotation-shaft-direction end.

8. The multi-blade centrifugal blower according to claim 7, wherein the part of the outside periphery is disposed at the side of the one rotation-shaft-direction end.

9. The multi-blade centrifugal blower according to claim 1, wherein the taper portion has one of a substantial line shape and a substantial arc shape.

10. The multi-blade centrifugal blower according to claim 1, wherein at least one part of an outside periphery of the blade is arranged parallel to the rotation shaft.

11. The multi-blade centrifugal blower according to claim 1, wherein:

the side plate has a substantial ring shape;

the main plate has one of a substantial round-disk shape and a substantial cone shape; and the blade, the side plate and the main plate are integrated and made of resin.

12. A multi-blade centrifugal blower comprising:

an impeller wheel which is rotatable with respect to a rotation shaft thereof, the impeller wheel having a plurality of blades which are arranged around the rotation shaft, a side plate which is connected with each of the blades at a side of one rotation-shaft-direction end of the blade, and a main plate which is connected with each of the blades at a side of an other rotation-shaft-direction end of the blade, the main plate being integrated with the rotation shaft; and a casing for accommodating the impeller wheel, wherein:

when the impeller wheel is rotated, air is sucked through a suction portion formed at the side of the one rotation-shaft-direction end and is blown toward a diameter-direction outer side of the impeller wheel;

an inside periphery of the blade has a taper portion which is arranged at least at the side of the one rotation-shaft-direction end, the taper portion tapering from the side of the other rotation-shaft-direction end toward the side of the one rotation-shaft-direction end;

in a cross section of each blade taken along a circumferential direction of the impeller wheel, the taper portion is positioned at a front side of a rotation direction R of the impeller wheel with respect to a back portion which is disposed at the side of the other rotation-shaft-direction end of the blade; and each of inlet angles throughout the taper portion has a value in a predetermined range, the inlet angles being respectively at cross sections of the blade which are perpendicular to the inside periphery of the blade in a meridional plane.

13. The multi-blade centrifugal blower according to claim 12, wherein each of the inlet angles throughout the taper portion has the value in the predetermined range substantially from 55° to 76°.

14. The multi-blade centrifugal blower according to claim 13, wherein the inlet angles of the taper portion are equal to or smaller than 74°.

15. The multi-blade centrifugal blower according to claim 12, wherein each of the inlet angles throughout the taper portion has the value in the predetermined range substantially from 51° to 74°.

16. The multi-blade centrifugal blower according to claim 12, wherein a variation in the inlet angles throughout the taper portion is in a range from −5° to +5°.

17. The multi-blade centrifugal blower according to claim 12, wherein a variation in inlet angles throughout the inside periphery of the blade is in a range from −5° to +5°, the inlet angles being respectively at cross sections taken along division lines Z1-Zn which respectively connect inside-periphery division points X1-Xn with outside-periphery division points Y1-Yn, the inside-periphery division points X1-Xn being evenly dispersed at the whole inside periphery and being arranged sequentially from the side of the one rotation-shaft-direction end to the side of the other rotation-shaft-direction end, each of the inside-periphery division points X1-Xn being distanced from the adjacent inside-periphery division points by a same length along the inside periphery, the outside-periphery division points Y1-Yn being evenly dispersed at a whole outside periphery of the blade and being arranged sequentially from the side of the one rotation-shaft-direction end to the side of the other rotation-shaft-direction end, each of the outside-periphery division points Y1-Yn being distanced from the adjacent outside-periphery division points by a same length along the outside periphery, the division line Zi (i=1, 2 . . . , n) connecting the inside-periphery division point Xi with the outside-periphery division point Yi, n being a predetermined number.

18. The multi-blade centrifugal blower according to claim 12, wherein at least a part of an outside periphery of the blade has a locus which backs in the rotation direction R from the side of the other rotation-shaft-direction end toward the side of the one rotation-shaft-direction end.

19. The multi-blade centrifugal blower according to claim 18, wherein the part of the outside periphery is disposed at the side of the one rotation-shaft-direction end.

20. The multi-blade centrifugal blower according to claim 12, wherein the taper portion has one of a substantial line shape and a substantial arc shape.

21. The multi-blade centrifugal blower according to claim 12, wherein at least one part of an outside periphery of the blade is arranged parallel to the rotation shaft.

22. The multi-blade centrifugal blower according to claim 12, wherein:

the side plate has a substantial ring shape;

the main plate has one of a substantial round-disk shape and a substantial cone shape; and the blade, the side plate and the main plate are integrated and made of resin.

* * * * *